US009241530B2

(12) United States Patent
Cho

(10) Patent No.: US 9,241,530 B2
(45) Date of Patent: Jan. 26, 2016

(54) SIZE HEADWEAR AND MANUFACTURING METHOD THEREOF

(75) Inventor: Byoung-Woo Cho, Gyeonggi-do (KR)

(73) Assignee: Yupoong, Inc. (KR)

( * ) Notice: Subject to any disclaimer, the term of this patent is extended or adjusted under 35 U.S.C. 154(b) by 1901 days.

(21) Appl. No.: 11/746,136

(22) Filed: May 9, 2007

(65) Prior Publication Data

US 2008/0276350 A1 Nov. 13, 2008

(51) Int. Cl.
*A42B 1/22* (2006.01)
*A42C 1/04* (2006.01)

(52) U.S. Cl.
CPC .... *A42C 1/04* (2013.01); *A42B 1/22* (2013.01)

(58) Field of Classification Search
USPC ..... 2/195.1
See application file for complete search history.

(56) References Cited

U.S. PATENT DOCUMENTS

| | | | | |
|---|---|---|---|---|
| 3,497,874 | A * | 3/1970 | Molitoris | 2/423 |
| 5,556,696 | A * | 9/1996 | Pinkus | 442/150 |
| 5,669,075 | A * | 9/1997 | Weeks | 2/172 |
| 5,715,540 | A | 2/1998 | Cho | |
| 5,862,522 | A | 1/1999 | Cho | |
| 6,067,658 | A | 5/2000 | Cho | |
| 6,089,421 | A | 7/2000 | Cho | |
| 6,129,250 | A | 10/2000 | Cho | |
| 6,199,213 | B1 | 3/2001 | Whang | |
| 6,282,721 | B1 * | 9/2001 | Travalgia | 2/171 |
| 6,343,382 | B2 * | 2/2002 | Sciglia | 2/200.1 |
| 6,493,880 | B1 * | 12/2002 | Lo | 2/195.2 |
| 2005/0066420 | A1 | 3/2005 | Kim | |
| 2005/0081279 | A1 | 4/2005 | Cho | |
| 2005/0160518 | A1 | 7/2005 | Cho | |
| 2005/0160519 | A1 | 7/2005 | Cho | |
| 2005/0223474 | A1 | 10/2005 | Cho | |
| 2005/0223475 | A1 * | 10/2005 | Turner | 2/209.4 |
| 2005/0235396 | A1 * | 10/2005 | Lee | 2/181 |
| 2007/0157366 | A1 | 7/2007 | Cho | |
| 2007/0294902 | A1 | 12/2007 | Cho | |
| 2008/0282448 | A1 * | 11/2008 | Cho | 2/181 |

* cited by examiner

*Primary Examiner* — Katherine Moran
(74) *Attorney, Agent, or Firm* — Fellers, Snider, Blankenship, Bailey & Tippens, P.C.

(57) ABSTRACT

A manufacturing method of a size headwear including a head covering portion put on a head and a size tape member disposed on a lower portion of the head covering portion, the head covering portion has a single circumferential length, includes forming a single set of patterns for forming a single set of pieces of the head covering portion; cutting a fabric into the single set of pieces according to the single set of patterns; sewing the cut pieces with each other and connecting the size tape member along a circumferential direction on a lower portion of the sewed pieces to form a raw size headwear; and putting a raw size headwear on a plurality of thermoforming apparatuses to thermoform a size headwear, wherein the thermoforming apparatuses have the respective different sizes. The size headwear thermoformed in this manner may be inexpensively and easily produced and maintain a predetermined stereoscopic shape due to stiffness so that it may improve an esthetic sense without doing the ironing.

5 Claims, 6 Drawing Sheets

| Sort | Part1 | Part2 | Part3 | Part4 | Part5 | Part6 | Part7 | Part8 | Part9 | Part10 | Part11 | Part12 |
|---|---|---|---|---|---|---|---|---|---|---|---|---|
| Prior art | 3~5% | | | | | | 0~2% | | | | | |
| Example | 0.06% | 0.73% | 0.88% | 1.31% | 1.17% | 0.24% | 0.00% | 1.40% | 1.54% | 0.43% | 1.06% | 0.39% |

*FIG. 5B*

| | Part1 | | | Part2 | | | Part3 | | | Part4 | | | Part5 | | | Part6 | | |
|---|---|---|---|---|---|---|---|---|---|---|---|---|---|---|---|---|---|---|
| | Before washing | After washing | Reduction ratio | Before washing | After washing | Reduction ratio | Before washing | After washing | Reduction ratio | Before washing | After washing | Reduction ratio | Before washing | After washing | Reduction ratio | Before washing | After washing | Reduction ratio |
| Articles1 | 16.5 | 16.5 | 0.00% | 16.5 | 16.3 | 1.21% | 17 | 16.8 | 1.18% | 19 | 18.5 | 2.63% | 17.1 | 16.9 | 1.17% | 16.4 | 16.2 | 1.22% |
| Articles2 | 16.6 | 16.6 | 0.00% | 16.5 | 16.3 | 1.21% | 17.1 | 17 | 0.58% | 19.1 | 18.8 | 1.57% | 17.1 | 16.8 | 1.75% | 16.2 | 16.2 | 0.00% |
| Articles3 | 16.6 | 16.6 | 0.00% | 16.6 | 16.5 | 0.60% | 17.2 | 16.9 | 1.74% | 19.1 | 18.8 | 1.57% | 17.3 | 16.9 | 2.31% | 16.5 | 16.4 | 0.61% |
| Articles4 | 16.5 | 16.5 | 0.00% | 16.5 | 16.5 | 0.00% | 17.2 | 17.1 | 0.58% | 19.1 | 19 | 0.52% | 17.1 | 17 | 0.58% | 16.5 | 16.5 | 0.00% |
| Articles5 | 16.5 | 16.5 | 0.00% | 16.5 | 16.3 | 1.21% | 17 | 16.8 | 1.18% | 19 | 18.7 | 1.58% | 17.1 | 16.9 | 1.17% | 16.4 | 16.3 | 0.61% |
| Articles6 | 16.5 | 16.5 | 0.00% | 16.5 | 16.5 | 0.00% | 17.2 | 17.1 | 0.58% | 19.1 | 19 | 0.52% | 17.1 | 17 | 0.58% | 16.5 | 16.5 | 0.00% |
| Articles7 | 16.6 | 16.5 | 0.60% | 16.5 | 16.3 | 1.21% | 17.1 | 17 | 0.58% | 19 | 18.8 | 1.05% | 17 | 16.8 | 1.18% | 16.2 | 16.2 | 0.60% |
| Articles8 | 16.5 | 16.5 | 0.00% | 16.5 | 16.5 | 0.00% | 17.2 | 17.1 | 0.58% | 19.1 | 19 | 0.52% | 17.1 | 17 | 0.58% | 16.5 | 16.5 | 0.00% |
| Articles9 | 16.5 | 16.5 | 0.00% | 16.5 | 16.4 | 0.61% | 17 | 16.8 | 1.18% | 19 | 18.7 | 1.58% | 17.1 | 17 | 0.58% | 16.4 | 16.4 | 0.00% |
| Articles10 | 16.6 | 16.6 | 0.00% | 16.5 | 16.3 | 1.21% | 17.1 | 17 | 0.58% | 19.1 | 18.8 | 1.57% | 17.1 | 16.8 | 1.75% | 16.2 | 16.2 | 0.00% |

| | Part7 | | | Part8 | | | Part9 | | | Part10 | | | Part11 | | | Part12 | | |
|---|---|---|---|---|---|---|---|---|---|---|---|---|---|---|---|---|---|---|
| | Before washing | After washing | Reduction ratio | Before washing | After washing | Reduction ratio | Before washing | After washing | Reduction ratio | Before washing | After washing | Reduction ratio | Before washing | After washing | Reduction ratio | Before washing | After washing | Reduction ratio |
| Articles1 | 10 | 10 | 0.00% | 9.3 | 9.1 | 2.15% | 11.6 | 11.4 | 1.72% | 11.6 | 11.5 | 0.86% | 9.3 | 9.2 | 1.08% | 10.1 | 10 | 0.99% |
| Articles2 | 10 | 10 | 0.00% | 9.2 | 9.1 | 1.09% | 11.7 | 11.5 | 1.71% | 11.3 | 11.3 | 0.00% | 9.3 | 9.2 | 1.08% | 10.1 | 10.1 | 0.00% |
| Articles3 | 10 | 10 | 0.00% | 9.5 | 9.3 | 2.11% | 11.9 | 11.7 | 1.68% | 11.6 | 11.6 | 0.00% | 9.6 | 9.4 | 2.08% | 10.1 | 10.1 | 0.00% |
| Articles4 | 10 | 10 | 0.00% | 9.3 | 9.1 | 2.15% | 11.6 | 11.4 | 1.72% | 11.6 | 11.5 | 0.86% | 9.3 | 9.2 | 1.08% | 10.1 | 10 | 0.99% |
| Articles5 | 10.1 | 10.1 | 0.00% | 9.3 | 9.3 | 0.00% | 11.5 | 11.4 | 0.87% | 11.6 | 11.5 | 0.86% | 9.2 | 9.2 | 0.00% | 10.1 | 10.1 | 0.00% |
| Articles6 | 10 | 10 | 0.00% | 9.2 | 9.1 | 1.09% | 11.7 | 11.5 | 1.71% | 11.3 | 11.3 | 0.00% | 9.3 | 9.2 | 1.08% | 10.1 | 10.1 | 0.00% |
| Articles7 | 10 | 10 | 0.00% | 9.5 | 9.3 | 2.11% | 11.9 | 11.7 | 1.68% | 11.6 | 11.6 | 0.00% | 9.6 | 9.4 | 2.08% | 10.1 | 10.1 | 0.00% |
| Articles8 | 10 | 10 | 0.00% | 9.3 | 9.1 | 2.15% | 11.6 | 11.4 | 1.72% | 11.6 | 11.5 | 0.86% | 9.3 | 9.2 | 1.08% | 10.1 | 10 | 0.99% |
| Articles9 | 10.1 | 10.1 | 0.00% | 9.3 | 9.3 | 0.00% | 11.5 | 11.4 | 0.87% | 11.6 | 11.5 | 0.86% | 9.2 | 9.2 | 0.00% | 10.1 | 10 | 0.99% |
| Articles10 | 10 | 10 | 0.00% | 9.2 | 9.1 | 1.09% | 11.7 | 11.5 | 1.71% | 11.3 | 11.3 | 0.00% | 9.3 | 9.2 | 1.08% | 10.1 | 10.1 | 0.00% |

SIZE HEADWEAR AND MANUFACTURING METHOD THEREOF

BACKGROUND OF THE INVENTION (a) Field of the Invention

The present invention relates to a headwear that has a single circumferential length for all respective sizes thereof (hereinafter, referred to as a size headwear) and a manufacturing method thereof. More particularly, the present invention relates to a size headwear and a manufacturing method thereof capable of being easily manufactured by a thermoforming method of an elastic fabric, in which the elastic fabric is woven or knitted to contain a thermoforming thread.

(b) Description of the Related Art

Generally, a headwear includes a head covering portion put on the head and a visor portion connected to at least part of a lower portion of the head covering portion to block sunlight etc.

Further, the headwear includes a sweat absorbing member provided between the head covering portion and the visor portion such that it can absorb sweat discharged from the forehead.

In addition, such a headwear includes a size adjusting member at the rear portion thereof so that the headwear may be adjusted to various sizes by the size adjusting member. However, recently a size headwear has been widely used, in which the headwear has no size adjusting member and it has various different sizes of circumferential length so that a wearer may wear an appropriate size thereof.

It is convenient to put on and off because the size headwear does not have any complicated members, such as the size adjusting member. In addition, the wearer does not need for the size adjusting member to adjust a size in correspondence to the circumferential length. That is, the wearer has only to select a headwear corresponding to his/her size. Moreover, it can provide a lighter and slimmer design.

In addition, the size headwear has merits in that it can save the expense and labor of additionally manufacturing the size adjusting member and connecting the same to the headwear and in that it can prevent the headwear from being blown off or put off since the size headwear is selected in correspondence with the wearer's size.

For example, the size headwear may be formed by at least five knitted fabric panels, and the size headwear may be classified into 8 to 12 sizes.

When 8 to 12 types of headwear are to be manufactured according to such 8 to 12 classified sizes, 8 to 12 types of patterns for forming the at least five knitted fabric panels are required, 8 to 12 types of the at least five knitted fabric panels must be cut according to the 8 to 12 types of patterns, and the respective sets of 8 to 12 types of the at least five knitted fabric panels must be independently managed and sewed together to provide each different sizes.

Thus, since the respective sets of patterns are separately managed and also the respective sets of fabric panel are separately sorted according to the respective sizes, there are many problems, such as size errors. This is very critical for producing a size headwear.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a size headwear and a manufacturing method thereof having the advantages of reducing the number of the respective sets of patterns to be managed, and accordingly, reducing the number of the respective sets of fabric panels cut in correspondence with the respective sets of patterns.

The present invention has also been made in an effort to provide a size headwear and a manufacturing method thereof having the advantages of reducing a production cost and size errors and of improving productivity.

The present invention has been made in an effort to provide a size headwear and a manufacturing method thereof having advantages of reducing a number of processes for manufacturing a size headwear.

The present invention has been made in an effort to provide a size headwear and a manufacturing method thereof having advantages of conveniently utilizing out of door, providing a good design, and preventing from being blown off.

An exemplary embodiment of the present invention provides a manufacturing method of a size headwear including a head covering portion put on a head and a size tape member disposed on a lower portion of the head covering portion, wherein the head covering portion has a single circumferential length. The manufacturing method includes forming a single set of patterns for forming a single set of pieces of the head covering portion; cutting a fabric into the single set of pieces according to the single set of patterns; sewing the cut pieces with each other and connecting the size tape member along the circumferential direction on a lower portion of the sewed pieces to form a raw size headwear; and putting the raw size headwear on one of a plurality of thermoforming apparatuses to thermoform the size headwear, wherein the plurality of thermoforming apparatuses respectively have different sizes. The set of pieces may be woven or knitted such that a low melting point fiber is disposed in the center of a texture of the pieces. The low melting point fiber may include a polyester fiber and may be contained in range of 8 to 32%. The heating of the raw size headwear may include maintaining the thermoforming apparatus at a temperature of about 160° C. to 200° C. for 20 to 30 seconds and then maintaining the heated raw size headwear on thermoforming apparatus at a temperature of about 15° C. to 25° C. for 5 seconds.

An exemplary embodiment of the present invention provides a size headwear including a head covering portion for covering a head and a size tape member disposed on a lower portion of the head covering portion, wherein the size tape member has a single circumferential length and the head covering portion is woven or knitted to contain a low melting point fiber.

The low melting point fiber may include a polyester fiber. The size headwear may have a reduction ratio of less than about 0 to 1.5%. The head covering portion may have stiffness and may have a polyester fiber film in an inner layer thereof.

BRIEF DESCRIPTION OF THE DRAWINGS

FIG. 5A and FIG. 5B respectively is a table of an average reduction ratio and a washing reduction ratio for comparing a prior art to an exemplary example.

DETAILED DESCRIPTION OF THE EMBODIMENTS

A preferred exemplary embodiment of the present invention will be described with reference to attached drawings. As those skilled in the art would realize, the described embodiments may be modified in various different ways, all without departing from the spirit or scope of the present invention.

According to an exemplary embodiment of the present invention, a headwear is formed by a single layer of fabric. However, a headwear may be formed by multiple layers of fabric. The headwear may be used when a wearer exercises, such as jogging, at batting practice, and when a wearer is out of doors, such as at a each.

Figure 1:
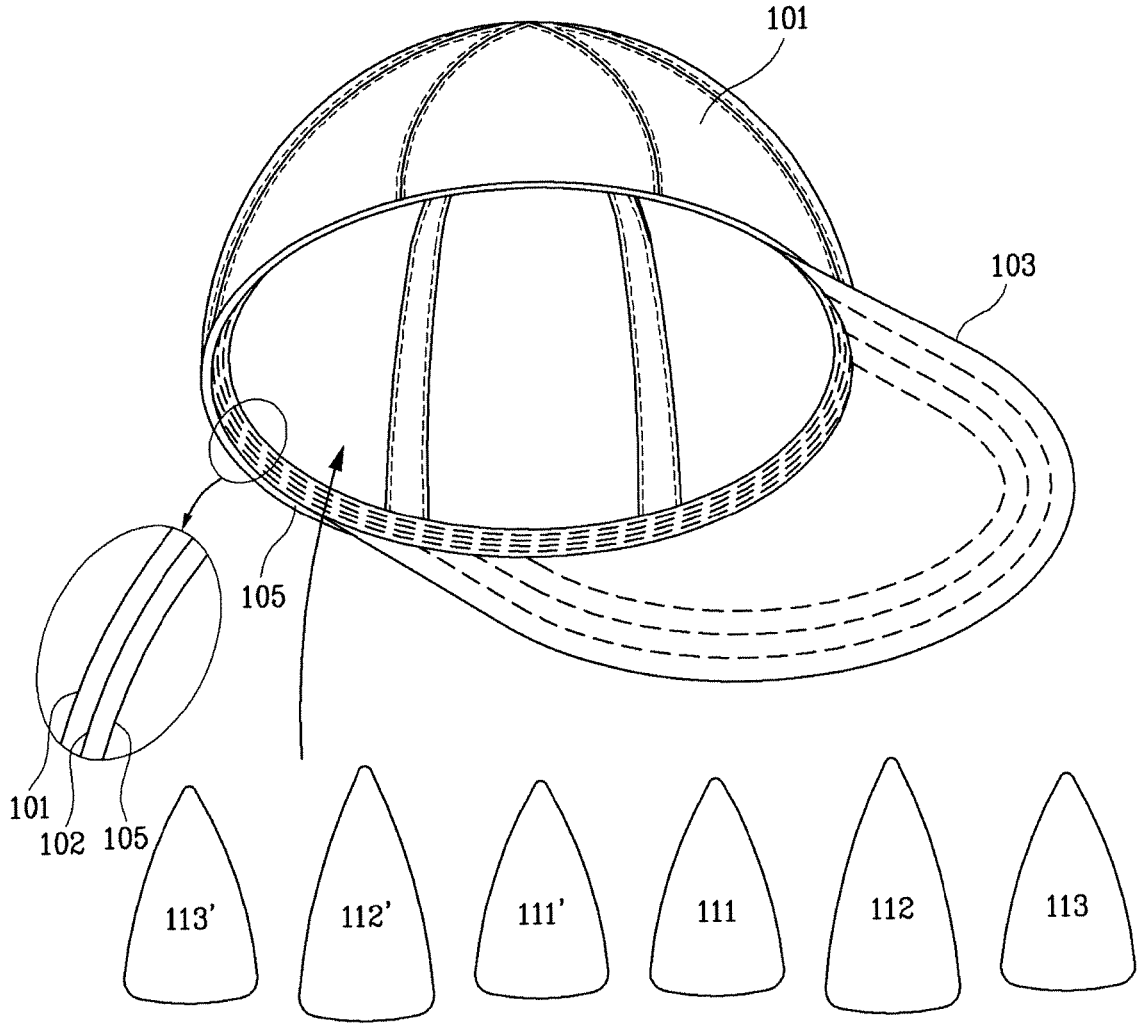
FIG. 1 schematically illustrates a perspective view of a size headwear having a set of pieces according to an exemplary embodiment of the present invention.
Figure 2:
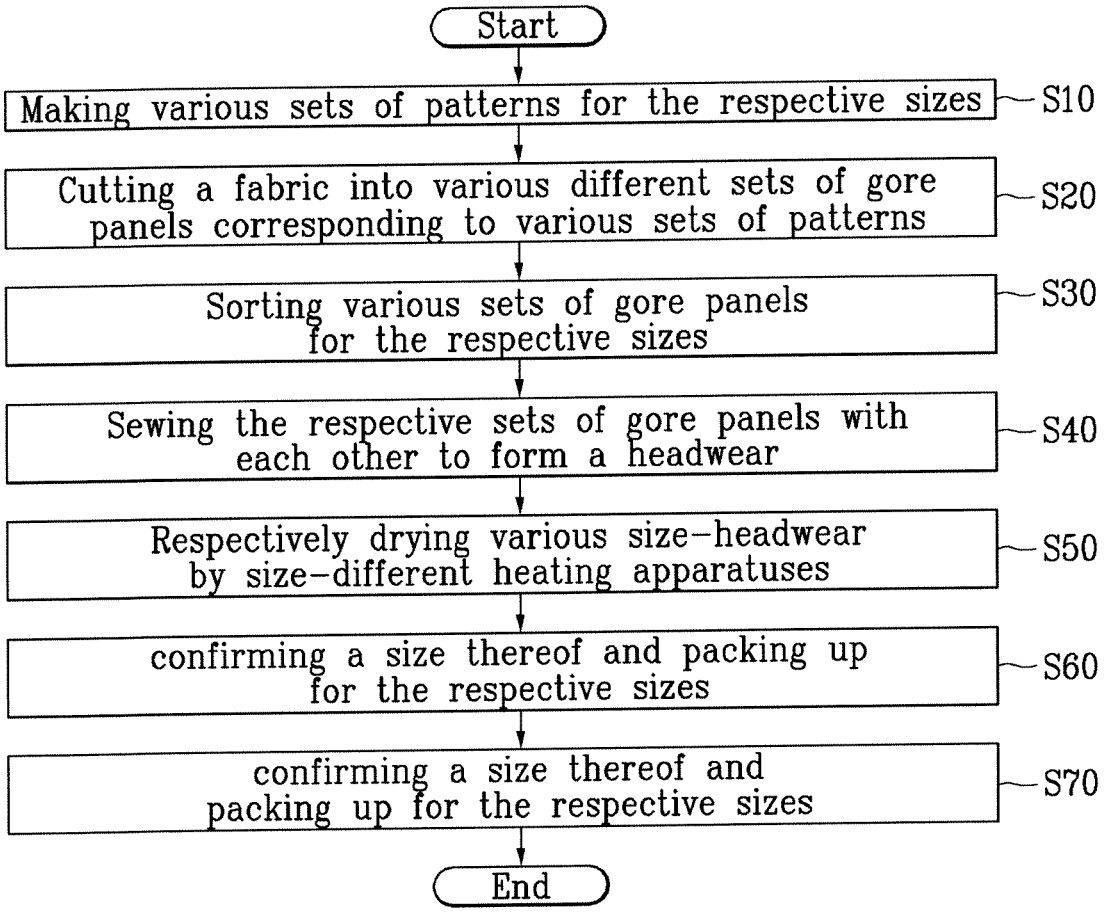
FIG. 2 is a flowchart for showing a conventional manufacturing method of a size headwear.
Figure 3:
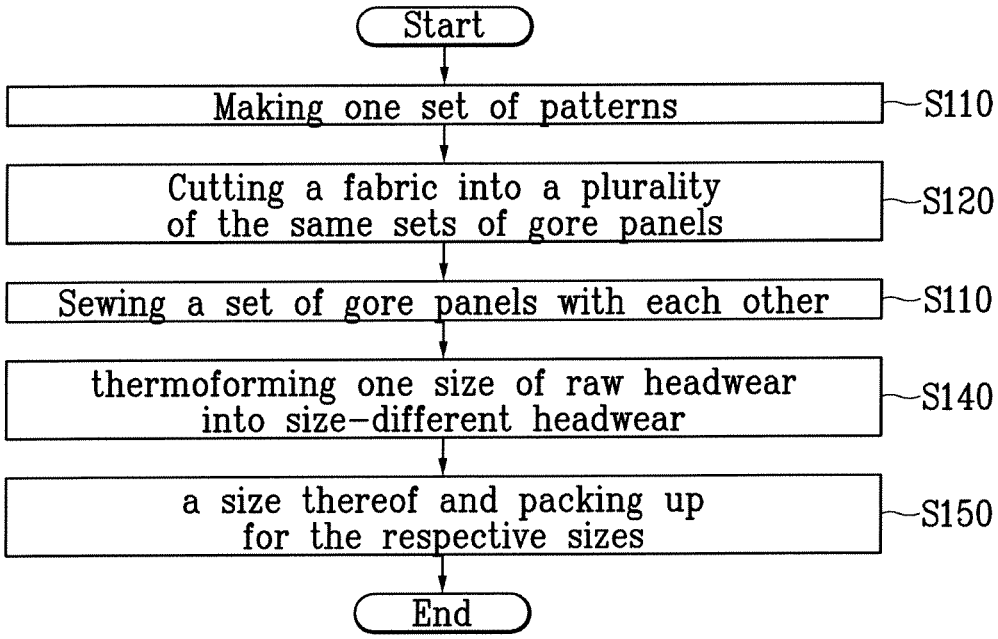
FIG. 3 is a flowchart for showing a manufacturing method of a size headwear according to an exemplary embodiment of the present invention.
Figure 4:
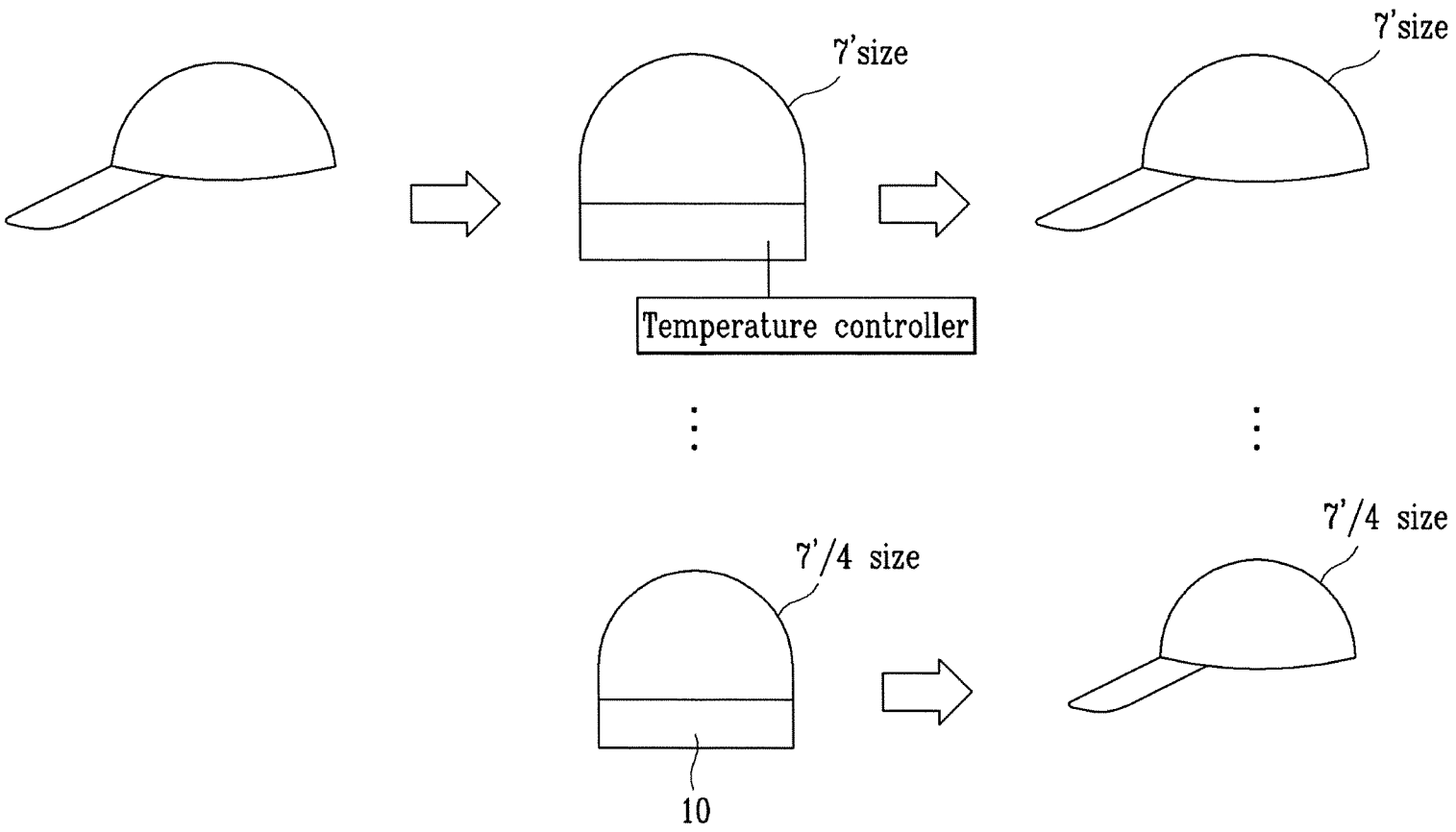
FIG. 4 schematically illustrates a manufacturing method of a size headwear according to an exemplary embodiment of the present invention.

FIG. 1 schematically illustrates a perspective view of a size headwear having a set of pieces according to an exemplary embodiment of the present invention, FIG. 2 is a flowchart for showing a conventional manufacturing method of a size headwear, and FIG. 3 is a flowchart for showing a manufacturing method of a size headwear according to an exemplary embodiment of the present invention.

According to an exemplary embodiment of the present invention, a size headwear may include a head covering portion 101 put on a head, a visor portion 103 connected to a lower portion of the head covering portion 101, and a sweat absorber 105 connected along a circumferential direction to a lower portion of the head covering portion 101, as shown in FIG. 1.

The head covering portion 101 is formed by sewing a plurality of pieces (111, 112, 113, 111', 112', 113') with each other (hereinafter, referred to as 'a set of pieces' because it is essential to manufacture a head covering portion 101). A size tape member 102 is attached to the lower portion of the head covering portion 101 along a circumferential direction. It is preferable for the size tape member 102 to have an elastic force only in a vertical direction so as to prevent the size tape member 102 from being extended or contracted in a horizontal direction. The size tape member 102 is prepared to have a predetermined size, and then it is connected to the lower portion of the sewed set of pieces.

As shown in FIG. 2, conventionally, for example, when two different sizes, e.g., 7 inch and 7⅛ inch of size headwear are desired, two different sets of patterns for 7 inch and 7⅛ inch are prepared (S10). Therefore, when the head covering portion 101 thereof is formed by 6 pieces, two different sets of patterns, i.e., a total of 12 patterns, are required.

Then, a set of pieces, that is, a first front panel 111, a first side panel 112, a first rear panel 113, a second front panel 111', a second side panel 112', and second rear panels 113' is cut for each size in correspondence to these sets of patterns (S20).

These sets of panels cut for each size in this manner, that is, the first front panel 111, the first side panel 112, the first rear panel 113, the second front panel 111', the second side panel 112', and the second rear panel 113' are sorted and disposed for each size (S30), and are respectively connected to each other by sewing (S40).

When each set of panels 111, 112, 113, 111', 112', and 113' are sewed with each other, a total circumferential length of the lower portion of the sewed set of panels 111, 112, 113, 111', 112', and 113' is measured (S50).

Generally, in the case of a 7-inch size headwear, the total circumferential length is given as 56 cm and in the case of a 7⅛ inch-size headwear, the total circumferential length is given as 57 cm. Accordingly, when the total circumferential length of the lower portion of the sewed set of panels 111, 112, 113, 111', 112', and 113' is measured, it is determined whether the headwear has the correct size. On the other hand, when the total circumferential length of the lower portion thereof is given as a predetermined value, the headwear is sorted and packed up. And also, when the total circumferential length of the lower portion thereof is not given as a predetermined value, the sewing portions of the set of panels may be undone or the headwear may be separately sorted and additionally managed due to the size error.

When the total circumferential total length of the lower portion of the set of panels 111, 112, 113, 111', 112', and 113' is given as a predetermined value, that is, the size headwear has no size error, ironing by a stereoscopic iron is performed. The stereoscopic iron has a size corresponding to the respective headwear sizes (S60).

Finally, the ironed size headwear is packed up according to the respective sizes (S70).

According to the conventional manufacturing method of the size headwear, it is very difficult to measure, sort, and manage the respective sizes of the size headwear when the size headwear has 8 to 12 sizes from 7 inch to 8 inch because 8 to 12 sets of patterns, that is, at least 50 patterns must be prepared and sorted, and accordingly, at least 50 different pieces must be cut according to the 8 to 12 sets of patterns, and they must be measured, sorted, managed, and do the ironed.

That is, there are many problems in that much time and labor is required to manufacture the various size headwears.

According to an exemplary embodiment of the present invention, the set of pieces may be knitted or weaved to contain a low melting point fiber (LM) such as 1 PE/LM/CT/PU=68/14/14/4 (PE=polyester, CT=cotton, PU=urethane span) or 2 AC/PE/LM/PU=40/42/14/4 (AC=acryl). Herein, the low melting point fiber is defined as a fiber which may be melting at a relative low temperature.

The low melting point fiber includes a polyester fiber which is melt at a temperature 160° C. to 200° C., provides a stickiness by heating, and crystallized by cooling. In the embodiment, the polyester-based low melting point fiber is selected from a group of 50D/24filament, 70D/24filament, and 150D/48filament. More preferably, the polyester-based low melting point fiber may be selected as 150D/48filament such that it may have a predetermined elasticity and strength.

When the polyester-based low melting point fiber is contained in range of 8 to 32% in the pieces, it is easy for the polyester-based low melting point fiber to be sticky to other mixed fibers and to thermoform the pieces without dropping down to the size headwear-thermoforming apparatus. Accordingly, it is easy to manufacture the size headwear because the headwear may be easily put on and off from the thermoforming apparatus.

It is preferable that the low melting point fiber is disposed in an inner layer of the pieces, on a center layer thereof when the pieces are knitted or weaved so that it may be widely dispersed and sticky well to the surrounding different fibers. Accordingly, the thermoforming process of the size headwear may be easily performed.

When the set of pieces includes a polyester fiber in the range of 8 to 32%, the polyester fiber may properly fix the surrounding different fibers in the pieces by being melted at the temperature of 160° C. to 200° C. for 20 to 30 seconds and then being rapidly cooled at the temperature of 15° C. to 25° C. in a range of 5 to 10 seconds. In addition, when the set of pieces includes the polyester fiber in the range of 8 to 32%, it may not be substantially reduced after being washed.

According to an exemplary embodiment of the present invention, the set of pieces of the head covering portion 101 may be knitted or weaved to include an elastic polyurethane or a polyester fiber having a stretch value of more than a predetermined value so that the head covering portion 101 may be extended to a predetermined size and it may be thermally fixed in the extended state by means of the low melting point fiber.

As shown in FIG. 3, according to an exemplary embodiment of the present invention, a single set of patterns corresponding to a predetermined size of a size headwear, for example, 6 patterns for manufacturing a 7-inch size headwear are prepared (S110).

Then, a single set of pieces, that is, a first front pieces 111, a first side pieces 112, a first rear panel 113, a second front pieces 111', a second side pieces 112', and a second rear pieces 113' are cut according to the single set of patterns (S120).

Several same sets of the same pieces 111, 112, 113, 111', 112', 113' may be cut at once, respective sets of pieces 111, 112, 113, 111', 112', and 113' are sewed with each other, an entire lower portion of the sewed single set of pieces 111, 112, 113, 111', 112', and 113' is extended along a circumferential direction, and then the extended lower portion thereof is connected to the size tape member 102 (S130). The lower portion thereof may be extended by the size of the size tape member 102 because that set of pieces of the head covering portion 101 may be knitted or weaved to contain an elastic polyurethane or polyester fiber having a stretch value of more than a predetermined value.

According to an exemplary embodiment of the present invention, when the extended lower portion of the sewed set of pieces 111, 112, 113, 111', 112', and 113' is connected to the size tape member 102, that is, the predetermined size tape member 102, for example, 7-inch tape member 102 and then the sweat absorbing member 105 is sequentially attached to the extended lower portion of the sewed set of pieces 111, 112, 113, 111', 112', and 113', and the size of the head covering portion 101 is determined as 7 inch.

At this time, the head covering portion 101 may have a shape where the lower portion thereof is extended and the upper portion thereof is not extended, which may be different from the desired shape.

According to an exemplary embodiment of the present invention, the respective size headwear in which the size tape member 102 is attached (hereinafter, referred to as a raw size headwear) may be put on a thermoforming apparatus so that it may be entirely extended and thermally fixed into a desired shape (S140). A plurality of thermoforming apparatuses may be prepared to have various sizes. The thermoforming apparatuses may be automatically controlled by a temperature controller to be maintained at the temperature of 160° C. to 200° C. for 20 to 30 seconds and to be rapidly cooled at the temperature of 15° C. to 25° C. in a range of 5 to 10 seconds. In addition, the thermoforming apparatus may include a heating apparatus maintained at the temperature of 160° C. to 200° C. and a cooling apparatus maintained at the temperature of 15° C. to 25° C., and accordingly, the raw size headwear may be moved from the heating apparatus to the cooling apparatus.

That is, the low melting point fiber contained in the fabric panel of the set of pieces 111, 112, 113, 111', 112', and 113' is melted and crystallized so that the headwear may maintain the entirely extended shape.

The thermoformed size headwear may be packed up for the respective sizes (S150).

As described above, according to an embodiment of the present invention, the plurality of sets of pieces containing a low melting point fiber of more than a predetermined ratio may be cut according to a predetermined size of a set of patterns, sewed with each other, and then be thermally fixed for the respective sizes, so that various size headwear may be inexpensively and easily produced.

In addition, the size headwear thermoformed in this manner may maintain a predetermined stereoscopic shape due to its stiffness so that it may improve an esthetic sense without requiring ironing.

Hereinafter, a reduction ratio of each part of a size headwear according to an exemplary embodiment of the present invention is compared to the same of a conventional size headwear. First, each part 1 to 12 of the size headwear thermoformed according to an exemplary embodiment of the present invention is prepared and each part 1 to 12 of the general headwear corresponding to the each part 1 to 12 is prepared. An average reduction ratio of each part 1 to 12 thereof is respectively measured and then a washing reduction ratio of each part 1 to 12 is respectively measured.

Figure 5A:
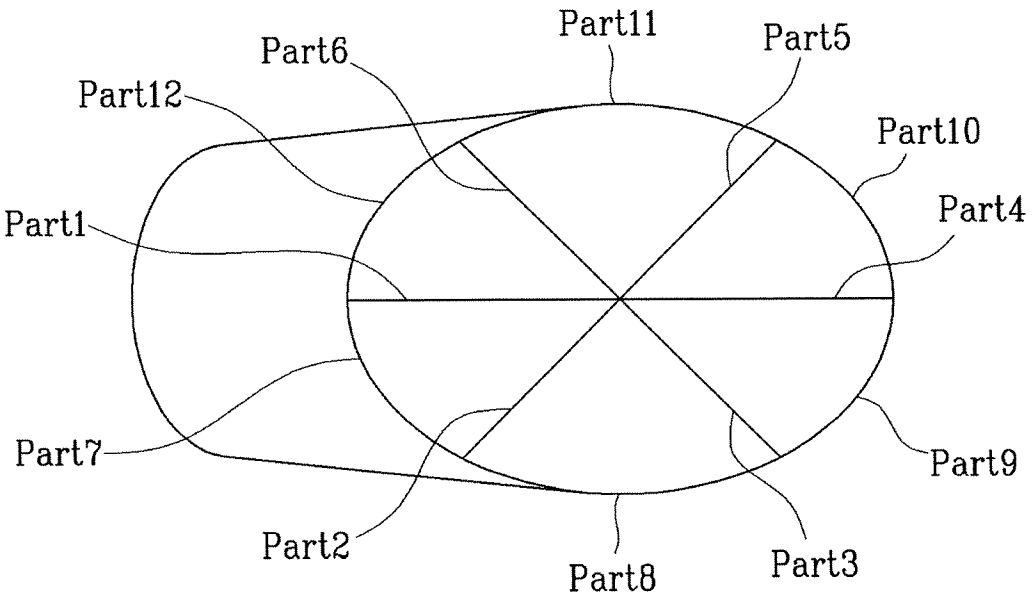

FIG. 5A and FIG. 5B respectively is a table of an average reduction ratio and a washing reduction ratio for comparing a prior art to an exemplary example.

As shown in FIG. 5A, each part 1 to 12 of the headwear thermoformed according to an exemplary embodiment of the present invention is compared to each part 1 to 12 of the general headwear. According to an exemplary embodiment of the present invention, each part 1 to 12 of the headwear thermoformed includes a low melting point fiber in range of 8 to 32% and accordingly, it is shown to have a reduction ratio of 0 to 1.5%. In contrast, it is shown that each part 1 to 6 of the general headwear has a reduction ratio of 3 to 5% and each part 7 to 12 has a reduction ratio of 0 to 2%. As a result, it is shown that the reduction ratio of the size headwear according to an exemplary embodiment of the present invention is more preferable.

In addition, as shown in FIG. 5B, comparing a washing reduction ratio of each part 1 to 12 of 10 different size headwear according to an exemplary embodiment of the present invention, it is shown that the predetermined thermoformed shape is maintained after washing.

According to an exemplary embodiment of the present invention, the number of patterns, and therefore, the number of pieces for the respective sizes of the size headwear to be managed may be reduced because it is not required to measure each different sizes of the sets of patterns and the corresponding set of pieces.

In addition, a production cost of the size headwear may be reduced and productivity thereof may be improved because size headwear of various sizes may be produced by thermoforming one set of panels cut according to one set of patterns of a predetermined size.

In addition, according to an exemplary embodiment of the present invention, a production process of the size headwear may be reduced and a size error of the size headwear may be reduced because each size of the one set of pattern, and therefore the corresponding set of pieces may not be measured at each process.

In addition, according to an exemplary embodiment of the present invention, the size headwear may be inexpensively provided so that it may be well used outdoors, it may not be easily blown off, and it may provide a good design.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A size headwear comprising a head covering portion for covering a head and a size tape member disposed on a lower portion of the head covering portion, wherein the size tape member has a predetermined circumferential length and the head covering portion is woven or knitted and comprises a low melting point fiber relative to other fibers of said head covering portion; and wherein the head covering portion is comprised of a plurality of fabric pieces, each of the plurality of fabric pieces being made of separate layers of fibers; and wherein a low melting point fiber is disposed in a center layer among said layers of fibers of each of the plurality of fabric pieces, said low melting point fiber in said center layer dispersed into engagement with said fibers in said separate layers of said fabric pieces;

wherein the head covering portion is comprised of fibers of said center layer that are dispersed into fibers of said outer layers wherein said fibers of said center layer are dispersed by thermoforming.

2. The size headwear of claim 1, wherein the low melting point fiber includes a polyester fiber.

3. The size headwear of claim 1, wherein the low melting point fiber comprises 8 to 32% of fibers comprising said head covering portion.

4. The size headwear of claim 3, wherein the head covering portion has a reduction ratio of less than about 0 to 1.5%.

5. The size headwear of claim 1, wherein the head covering portion has stiffness.

* * * * *